US005850911A

United States Patent [19]

Pakzad

[11] Patent Number: 5,850,911

[45] Date of Patent: Dec. 22, 1998

[54] BAG WITH INTEGRAL CUP HOLDERS

[75] Inventor: Bijan Pakzad, Bellevue, Wash.

[73] Assignee: Pacific Pier, Inc., Bellevue, Wash.

[21] Appl. No.: 923,544

[22] Filed: Sep. 4, 1997

[51] Int. Cl.[6] ..... B65D 71/00

[52] U.S. Cl. ..... 206/217; 206/162; 206/427; 383/38; 383/121.1

[58] Field of Search ..... 206/217, 218, 206/139, 162, 167, 193, 197, 427, 428; 229/120.11, 120.15, 120.32; 383/38, 40, 121, 121.1

[56] References Cited

U.S. PATENT DOCUMENTS

| | | | |
|---|---|---|---|
| 2,913,101 | 11/1959 | Daily | 206/216 |
| 4,114,796 | 9/1978 | Voges | 229/120.15 |
| 4,397,393 | 8/1983 | Pergande et al. | 229/120.15 |
| 4,601,390 | 7/1986 | Rosenthal et al. | 206/193 |
| 5,158,371 | 10/1992 | Moravek | 383/121 |
| 5,524,814 | 6/1996 | Davis | 229/120.15 |
| 5,697,707 | 12/1997 | Esposito et al. | 383/38 |

OTHER PUBLICATIONS

Burger King Card Board Cup Holder, shown in Photographs (2), taken Apr. 3, 1998.

*Primary Examiner*—Jim Foster
*Attorney, Agent, or Firm*—Seed and Berry LLP

[57] ABSTRACT

A bag for carrying liquid containers and other goods within the bag. The bag has a bottom panel and a plurality of side panels attached to the bottom panel such that the side panels in combination with the bottom panel define an interior space of the bag. A retaining strap is securely positioned within the interior space adjacent to one of the side panels. At least a portion of the retaining strap is spaced apart from one of the side panels to define a cotainer-receiving space therebetween. The retaining strap is sized to retain a selected container within the container-receiving space, and the remainder of the interior space is sized to simultaneously carry selected other goods therein when the selected container is retained within the container-receiving space.

24 Claims, 3 Drawing Sheets

BAG WITH INTEGRAL CUP HOLDERS

TECHNICAL FIELD

The present invention is directed toward a bag, and more particularly, toward a bag adapted to securely carry cups, containers and other selected goods placed inside the bag.

BACKGROUND OF THE INVENTION

In today's fast pace world, there are millions of consumers who purchase take-out food as a substitute for home cooking. Indeed, it has been estimated that in the United States alone, there are over 60 million "home replacement meals" purchased by consumers each day. These home replacement meals include meals purchased from fast-food restaurants, quick service markets, sandwich shops, delis, and the like. In general, the consumer who purchases a home replacement meal receives the meal in a carry out bag or on a carry out tray.

As is well known in the art, bags come in a variety of shapes and sizes and are generally effective for carrying goods. The prior art bags, however, are not optimally designed for carrying home replacement meals because these meals typically include liquid refreshments contained in one or more cups or containers. In general, the prior art bags have no means to secure the containers of liquid refreshment placed within the bag. Therefore, these containers may inadvertently tip over and spill liquid.

Another prior art device known for carrying home replacement meals is the carry out tray. The typical carry out tray is made of either pressed paper or Styrofoam and has retaining slots, for securing cups or containers of liquid refreshment. The disadvantages associated with carry out trays, however, are that they have a limited food carrying capacity and they are generally more cumbersome to carry than a bag. Accordingly, there is a need for a carrier that allows for simultaneously carrying food and beverages of a home replacement meal in an easy and efficient manner that protects against the beverage from spilling.

SUMMARY OF THE INVENTION

The present invention provides a bag that overcomes disadvantages associated with the prior art and provides additional benefits. An exemplary embodiment of the present invention includes a bag with at least one retaining strap for retaining a container within the bag. The bag has a bottom panel and a plurality of interconnected side panels attached to the bottom panel. The bottom panel and side panels define an interior space of the bag. The retaining strap is securely positioned within the bag's interior space adjacent to a selected one of the side panels. A portion of the retaining strap is spaced apart from the selected side panel to define a container-receiving space that is sized to receive a container therein. The retaining strap holds the container in the container-receiving, space and prevents the container from tipping over in the bag's interior space.

Another exemplary embodiment of the present invention includes a bag having a bottom panel, opposing first and second side panels attached to the bottom panel, and first and second end panels attached to the bottom panel and extending between the first and second side panels. In combination, the bottom panel, the first and second side panels, and the first and second end panels define an interior space of the bag. The first end panel has first and second cuts formed therein which define an upper portion above the first cut, a lower portion below the second cut, and an intermediate portion between the first and second cuts. The intermediate portion is movable relative to the upper and lower portions between stored and containing positions. In the stored position, the intermediate position is substantially coplanar with the upper and lower portions. In the containing position, the intermediate portion is within the interior space and spaced apart from the upper and lower portions so as to define a container-receiving space. The container-receiving space is sized to retain a container placed within the bag between the intermediate portion and the upper and lower positions, such that the container will not tip over within the interior space.

The present invention provides advantages over both prior art bags and carry out trays. An advantage over prior art bags is that the present invention allows for cups and containers of liquid refreshment to be securely retained so as to reduce the risk of spilling. An advantage over prior art carry out trays is that the present invention allows for a relatively expanded food carrying capacity in a relatively more convenient and easy to carry fashion.

These and other aspects of the present invention will become evident upon reference to the following detailed description and attached drawings. It is to be understood that various changes, alterations, and substitutions may be made to the teachings contained herein without departing from the spirit and scope of the present invention. It is to be further understood that the drawings are illustrative and symbolic of exemplary embodiments of the present invention.

DETAILED DESCRIPTION OF THE INVENTION

Figure 1:
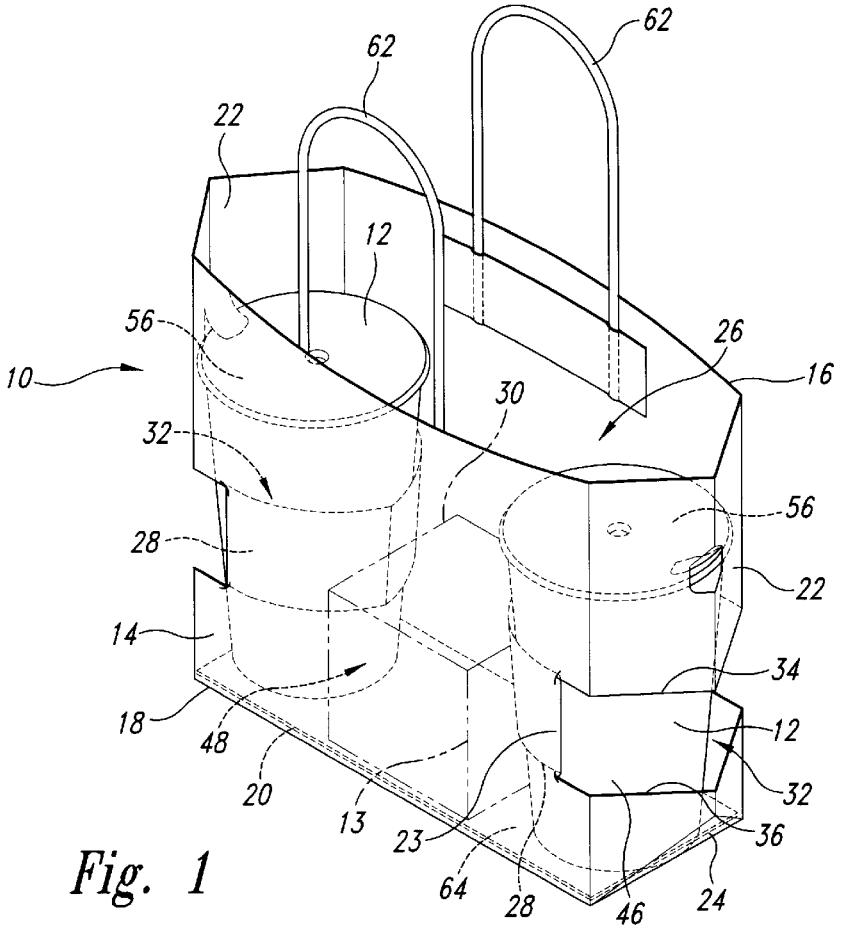
FIG. 1 is a top isometric view of a representative bag in accordance with the present invention with container retaining straps shown in hidden lines in a containing position and two containers shown retained by the retaining straps.

A bag 10 for carrying one or more selected containers 12 and other selected goods 13, shown in phantom lines, in accordance with the present invention is shown in the drawings for purposes of illustration. The bag 10 is adapted to simultaneously carry, for example, beverages and food products of a home replacement meal in an easy and convenient manner while preventing the beverages from tipping over and spilling in the bag.

As best seen in FIG. 1, the bag 10 includes opposing left and right side panels 14 and 16 connected along lower edge portions 18 to a bottom panel 20. Side edge portions 23 of the left and right side panels 14 and 16 are connected to opposing end panels 22 extending therebetween. The opposing end panels 22 are each connected along a lower edge portion 24 to the bottom panel 20. Accordingly, the bottom panel 20, the left and right side panels 14 and 16, and end panels 22 are interconnected to define an interior space 26 that is shaped and sized to receive and simultaneously retain therein the containers 12 and selected goods 13, such as food products or the like.

The bag 10 further includes two retaining straps 28, shown in hidden lines in FIG. 1, each of which is positioned within the interior space 26 adjacent to a respective one of the end panels 22. Each of the retaining straps 28 has a middle portion 30 that is spaced apart from the respective end panel 22 to define a container-receiving space 32 therebetween, such that the container-receiving space is immediately adjacent to the respective end panel. The retaining strap 28 engages a midportion of the container 12 and prevents it from tipping over and spilling within the bag's interior space 26.

Figure 2:
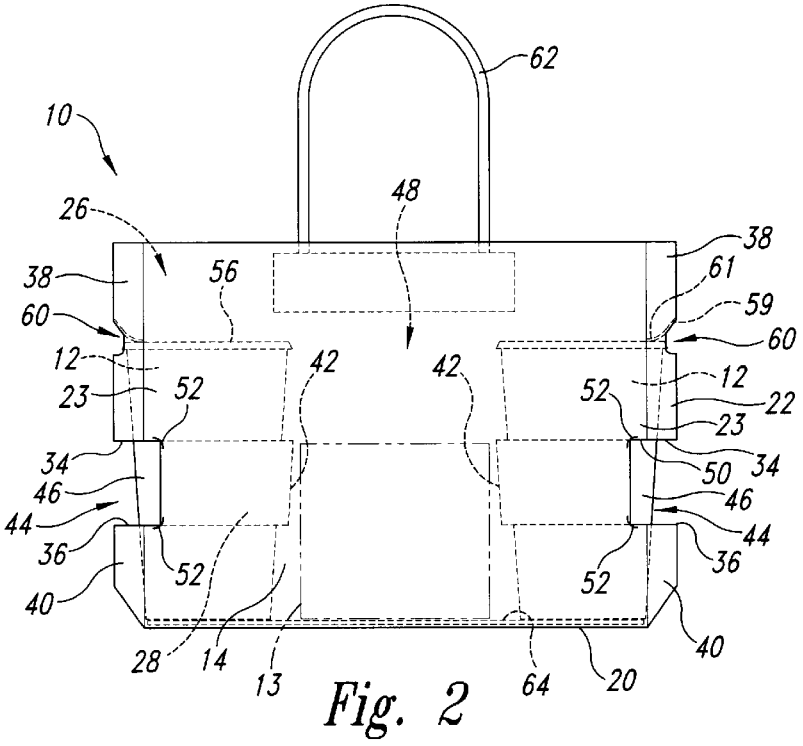
FIG. 2 is a left side elevational view of the bag of FIG. 1.
Figure 3:
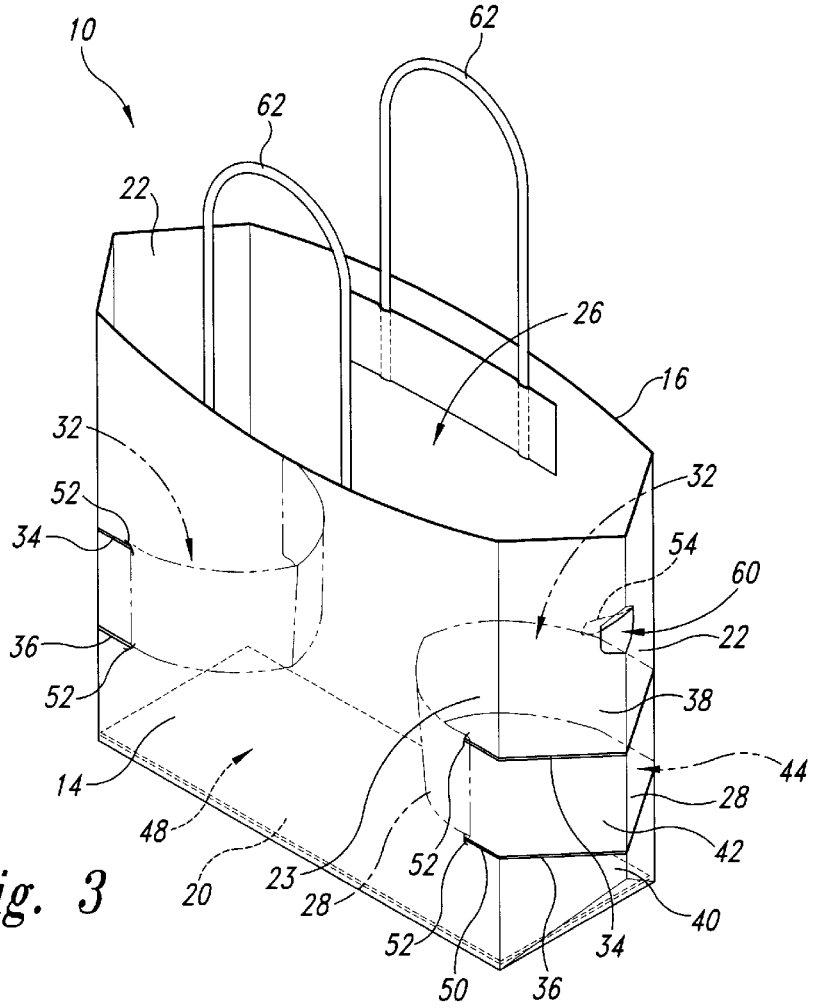
FIG. 3 is a top isometric view of the bag of FIG. 1 with the retaining straps shown in solid lines in a stored position and shown in phantom lines in the retaining position, without the containers being shown.

In the exemplary enbodiment illustrated in FIGS. 1 and 2, each retaining strap 28 is formed from the respective end panel 22 by parallel upper and lower separators or cuts 34 and 36 extending substantially horizontally along the respective end panel. The upper and lower cuts 34 and 36 divide the end panel 22 into an upper portion 38 above the upper cut, a lower portion 40 below the lower cut, and an intermediate portion 42 extending between the upper and lower cuts. As best seen in FIG. 3, the intermediate portion 42 forms the retaining strap 28, and the retaining strap is movable relative to the upper and lower portions 38 and 40 between a containing position, shown in phantom lines, and a stored position, shown in solid lines. In the containing position, the retaining strap 28 extends into the bag's interior space 26 and is spaced apart from the end panel's tipper and lower potions 38 and 40 of the end panel to relatively snugly receive and support against spillage of one of the containers 12. Accordingly, the retaining strap 28 and the end panel's upper and lower portions 38 and 40 define the container-receiving space 32 therebetween.

When the retaining strap 28 is in the containing position, the space between the upper and lower portions 38 and 40 of the end panel 22 defines an aperture 44 in the end panel. Accordingly, in the exemplary embodiment, the aperture 44 has substantially the same shape and size as the retaining strap 28 because the aperture is formed upon making the upper and lower cuts 34 and 36 and moving the retaining strap from the stored position to the containing position. As best seen in FIG. 2, when the container 12 is positioned in the container-receiving space 32, the aperture 44 is positioned so a middle portion 46 of the container 12 is visible through the aperture from the exterior of the bag 10. Accordingly, the aperture 44 allows a trademark or logo on the container's middle portion 46 to be displayed and seen from exterior of the bag 10.

When both of the retaining straps 28 of the bag 10 are in the containing position, the two retaining straps are spaced apart from each other within the bag's interior space 26 by a selected distance to define a goods-receiving space 48 therebetween. The goods-receiving space 48 is shaped and sized to receive the selected goods 13, such as food products of a home replacement meal, while the beverage containers 12 of the home replacement meal are securely retained in the container-receiving spaces 32 by the retaining straps 28.

When the retaining straps 28 are in the stored position, each retaining strap is substantially coplanar with the respective end panel's upper and lower portions 38 and 40. Accordingly, the volume of the goods-receiving, space 48 usable for selected goods is expanded and maximized when the retaining straps 28 are not needed to retain containers therein.

In the exemplary embodiment each upper and lower cuts 34 and 36 extend fully across the respective end panel 22 and extend a selected distance into the adjacent side edge portions 23 of the left and right side panels 14 and 16. The selected distance that the upper and lower cuts 34 and 36 extend into the adjacent side edge portions 23 is determined by the size desired for the container-receiving space 32. If a larger container-receiving space 32 is desired, the upper and lower cuts 34 and 36 extend further into the adjacent side edge portions 23 away from the respective end panel 22. Conversely, a smaller container-receiving space 32 is provided by upper and lower cuts 34 and 36 that extend only slightly into the adjacent side edge portions 23. In an alternate embodiment, the upper and lower cuts 34 and 36 terminate at ends that are located in the respective end panel 22, so the container-receiving space 32 is smaller than in the illustrated exemplary embodiment. In this alternate embodiment, moving the retaining strap 28 to the containing position may cause some deformation or buckling of the end panel 22, which can cause the respective end panel to generally correspond to a portion of the container's shape.

As best seen in FIG. 2 and 3, each of the upper and lower cuts 34 and 36 has a horizontal end portion 50 formed in each adjacent side edge portion 23 of the side panels 14 and 16. Each horizontal end portion 50 is formed as a curved stop cut 52 formed in each end of the upper and the lower cuts 34 and 36. Each curved stop cut 52 has a partially circular shape, such that each stop cut is transverse to the horizontal end portion 50 of the respective upper or lower cut 34 or 36. The curved stop cuts 52 are shaped and positioned to resist tearing, ripping, or the like of the side panel's side edge portion 23 past the horizontal end portions 50, which would extend the length of the upper or lower cut 34 or 36, thereby damaging the bag and inadvertently lengthen the retaining strap 28.

The bag 10 of the illustrated exemplary embodiment is constructed of paper, such that preventing or minimizing tearing of the horizontal end portions 50 of the upper and lower cuts 34 and 36 is particularly important. In alternate embodiments, the bag 10 is constructed of other material, such as fabric, plastic, or the like. In these alternate embodiments, other techniques for preventing tearing are used, such as additional stitching in the fabric or plastic deposits in the plastic material at the ends of the upper and lower cuts 34 and 36.

Figure 4:
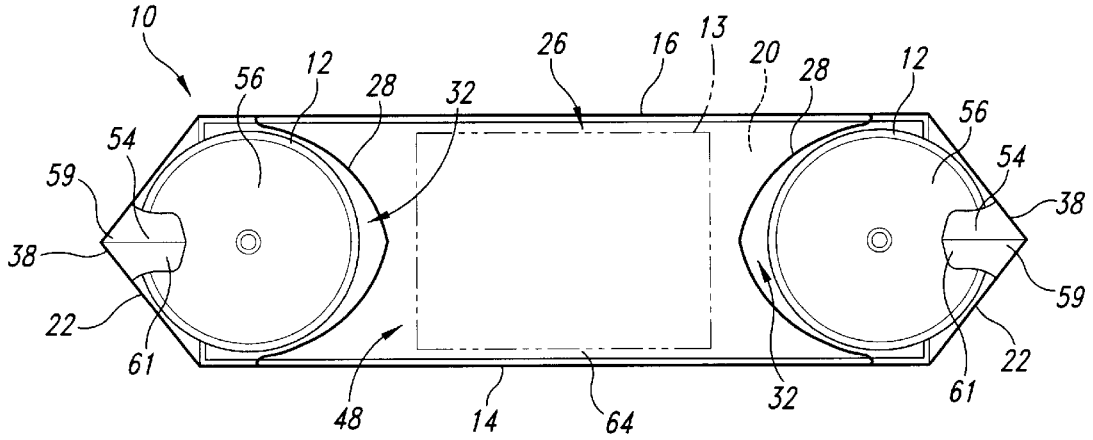
FIG. 4 is an enlarged top plan view of the bag, of FIG. 1.

As best seen in FIG. 3 and 4, the bag 10 further includes a retaining tab 54 formed in the upper portion 38 of each end panel 22. The retaining tab 54 is positionable to extend partially into the bag's interior space 26 above the container-receiving space 32. Each retaining tab 54 is positioned to engage a top portion 56 of the container 12 (FIG. 3) when positioned in the container-receiving space 32. The retaining tab 54 is sized and positioned to engage the container's top portion 56 and prevent the container 12 from bouncing or otherwise moving up and down within the container-receiving area 32 when the container is being carried in the bag, for example, with the rest of a home replacement meal. In the exemplary embodiment, the retaining tabs 54 are formed from a portion of the end panel's upper portion 38 and are each defined by a contoured, generally U-shaped, cut 58 formed therein. Accordingly, the retaining tab's upper portion 59 is integrally connected to the end panel's upper portion 38 and the retaining tab's lower portion 61 is movable relative to the end panel's upper portion.

In the exemplary enibodiment shown in FIG. 1, each of the retaining tabs 54 is movable relative to the respective end panel's upper portion 38 between a stored position wherein the retaining tab is substantially co-planar with the upper portion, and a retaining position wherein the retaining tab extends partially into the bag's interior space 26. When the retaining tab 54 is in the retaining position, its lower end 61 is spaced apart from the end panel's upper portion 38, thereby forming an aperture 60 in the upper portion.

When the container 12 is cup-shaped and is positioned in the container-receiving area 32 and the retaining tab 54 is moved into the retaining position, the retaining tab engages the container's top portion 56 and the aperture 60 is adjacent to the container's top edge. When a narrow-necked bottle (not shown) or the like is positioned in the container-receiving area 32, the retaining tab 54 is moved to the retaining position, and the top of the bottle can be positioned to extend through the aperture 60 thereby providing additional protection against the bottle tipping over in the bag 10.

As best seen in FIG. 3, the bag 10 has two carrying handles 62, one attached to each of the left and right side panels 14 and 16. The carrying handles 62 are conventional handles shaped and sized to allow a user to carry the bag 10 with one hand while the containers 12 and selected goods 13 are within the bag.

The bag 10 also has an interior reinforcement panel 64 positioned in the bag's interior space 32 covering the bottom panel 20. The reinforcement panel 64 is removably attached to the bottom panel 20 and is shaped and sized to reinforce the bottom panel. When reinforcement of the bottom panel 20 is not needed, the reinforcement panel 20 can be removed form the bag's interior area 26. In an alternate embodiment, the reinforcement panel 20 is adhered to the bottom panel 20 and is not removable. In the exemplary embodiment, the reinforcement panel 64 is constructed of cardboard, although other material, such as plastic, wood, or the like, having sufficient stiffness could be used.

In the exemplary embodiment illustrated in the drawings, the retaining strap 28 is formed by the intermediate portion 42 of the respective end panel 22. In an alternate embodiment, not shown, the retaining strap 28 is a separate component that is securely adhered at each end to one of the bag's end panel 22 so as to define the container-receiving space 32 between the retaining strap and the end panel. In another alternate embodiment (not shown), each separate retaining strap 28 has its ends securely adhered to the side edge portions 23 of both side panels 14 and 16 at locations adjacent to the end panels 22, so the container-receiving space 32 is adjacent to the end panel. In another alternate embodiment, the retaining strap 28 is securely adhered at each end to a selected one of the left or right side panels, 14 or 16 respectively, and extends away from the side panel into the bag's interior space, so the container-receiving space 32 is between the retaining strap and the selected one of the left or right side panel.

Figure 5:
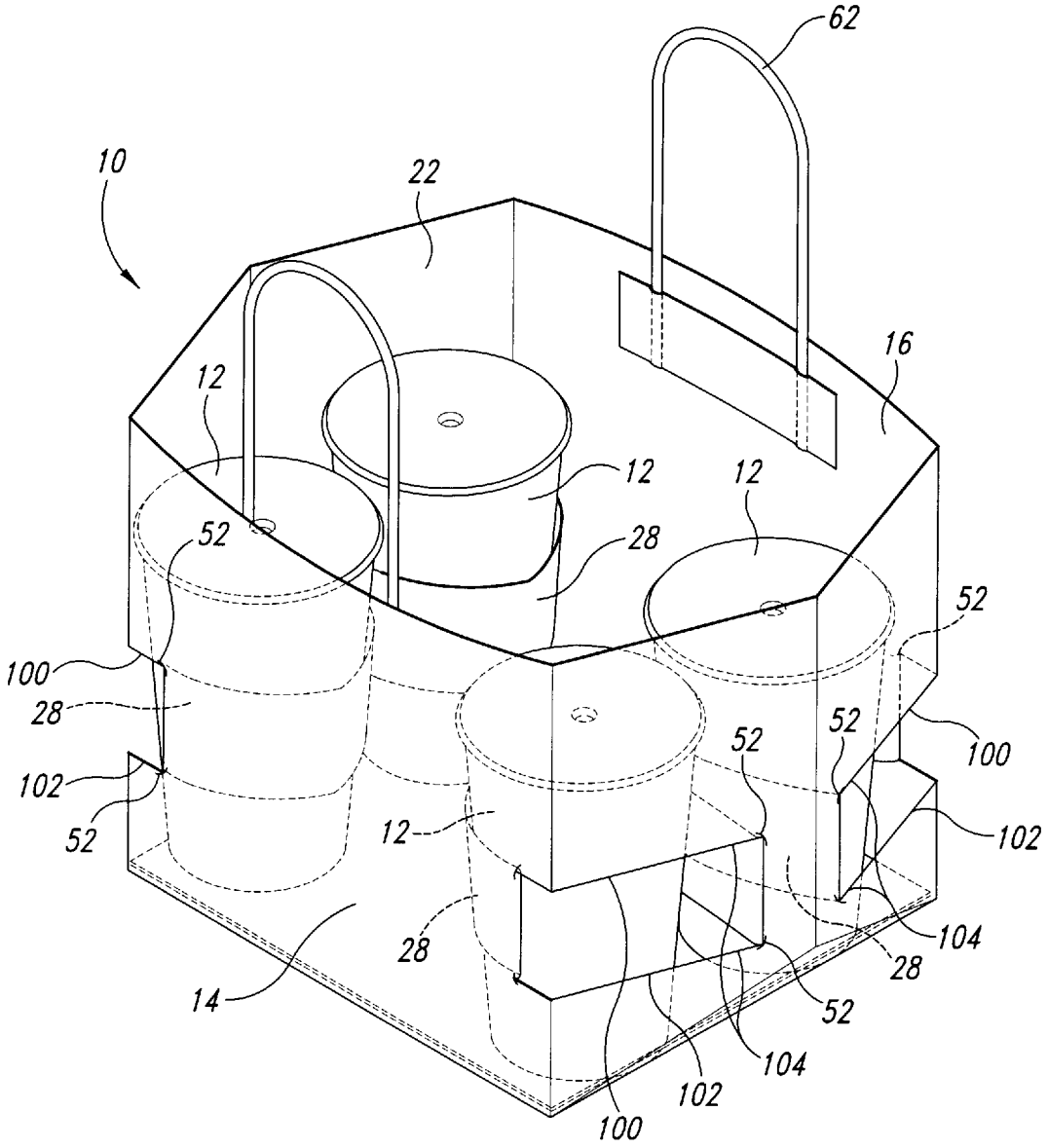
FIG. 5 is a top isometric view of an alternate embodiment of a representative bag in accordance with the present invention with container retaining straps shown in hidden lines in a containing position and four containers shown in phantom lines retained by the retaining straps.

In an alternate embodiment shown in FIG. 5, the bag 10 includes two retaining straps 28 at each of the two end panels 22 so as to retain four containers within the bag. Each retaining strap 28 is formed by parallel, generally horizontal, upper and lower cuts 100 and 102 extending from a side panel's side edge portion 23 into the adjacent end panel 22 a selected distance along the end panel to end portions 104 of the cuts. The retaining straps 28 adjacent to each other in each end panel 22 are spaced apart from each other so the end portions 104 of the adjacent upper cuts 100 and the end portions 104 of adjacent lower cuts 102 are spaced apart from each other by a selected length of the end panel.

Each end portion 104 of the upper and lower cuts 100 and 102 includes a curved stop cut 52, and similar curved stop cuts 52 are provided at the opposite end of each upper and lower cuts 100 and 102 in the side edge portion 23 of the respective left and right side panels 14 and 16. The curved stop cuts 52 are shaped and positioned to resist tearing or the like of the end panels 22 and side panels 14 and 16, which would inadvertently extend the respective upper and lower cuts 100 and 102.

From the foregohing it will be appreciated that, although exemplary embodiments of the present invention have been described herein for purposes of illustration, various modifications may be made without deviating from the spirit and scope of the invention. Accordingly, the present invention is not limited except by the following claims.

I claim:

1. A bag for carrying a selected container and selected other goods, comprising:

a bottom panel;

a plurality of side panels attached to the bottom panel, the side panels in combination with the bottom panel defining an interior space of the bag;

a retaining strap securely positioned within the interior space adjacent to one of the side panels, at least a portion of the retaining strap being spaced apart from the adjacent side panel to define a container-receiving space therebetween sized to retain the selected container therein, the interior space being sized to simultaneously carry the selected other goods therein when the selected container is retained in the container-receiving space; and a retaining tab attached to the adjacent side panel and extending into the interior space, the retaining tab being positioned to engage the selected container when positioned in the container-receiving space.

2. The bag of claim 1 wherein the retaining strap has first and second ends, the first end being attached to a first one of the side panels and the second end being attached to a second one of the side panels.

3. The bag of claim 1 wherein the retaining strap is integrally connected to first and second side panels.

4. The bag of claim 1 wherein the retaining strap is movable relative to the adjacent side panel between a stored position and a containing position, the retaining strap being positioned at the adjacent side panel when in the stored position, and the retaining strap extending into the interior space of the bag and away from the adjacent side panel when in the containing position so as to define the container-receiving space.

5. The bag of claim 1 wherein the adjacent side panel has an aperture therein such that a portion of the selected container is visible through the aperture from exterior of the bag when the selected container is in the container-receiving space.

6. The bag of claim 1 wherein the retaining strap is a first retaining strap and the bag further includes a second retaining strap securely positioned within the interior space adjacent to another one of the side panels, at least a portion of the second retaining strap being spaced apart from the other side panel to define a second container-receiving space therebetween sized to retain a second selected container therein, the first retaining strap being spaced apart from the second retaining strap by a goods-receiving portion of the interior space sized to carry the selected other goods therein.

7. The bag of claim 6 wherein the second retaining strap is formed by third and fourth cuts in the other side panels to separate the second retaining strap from a remainder portion of the other side panels.

8. The bag of claim 1 wherein the bottom panel, the plurality of side panels, and the retaining strap are paper.

9. The bag of claim 1, further comprising carrying handles attached to at least one of the side panels for carrying the bag.

10. The bag of claim 1, further comprising a reinforcement panel positioned atop the bottom panel within the interior space of the bag.

11. A bag for carrying a selected container, comprising:

a bottom panel;

a pair of opposing first and second side panels attached to the bottom panel;

a pair of opposing first and second end panels attached to the bottom panel and to the side panels, the bottom panel, the side panels, and the end panels in combination defining an interior space of the bag; and a retaining strap securely positioned within the interior space adjacent to the opposing first and second side panels and the first end panel, the retaining strap being sized to retain the container in a selected position in the interior space of the bag between the retaining strap and the first end panel, the retaining strap being formed by first and second cuts in the first end panel to separate the retaining strap from a remaining portion of the first end panel, the first and second cuts each having a first cut portion extending a first direction and having a stop cut portion connected to the first cut portion, the stop cut portion extending in a second direction that is different than the first direction and positioned to prevent the first cut portion from extending past the stop cut portion.

12. The bag claim 11 wherein the retaining strap is integrally connected to the first and second side panels.

13. The bag of claim 11 wherein the retaining strap is movable relative to the first end panel between a stored position and a containing position, the retaining strap being immediately adjacent to the first end panel when in the stored position, and the retaining strap extending into the interior space of the bag when in the containing position and defining a container-receiving space adjacent to the first end panel and sized to retain the container therein.

14. The bag of claim 11 wherein the first end panel has an aperture therein positioned such that a portion of the selected container is visible through the aperture from exterior of the bag when the container is in the selected position in the interior space of the bag.

15. The bag of claim 11 wherein the retaining strap is a first retaining strap and the bag further includes a second retaining strap securely positioned within the interior space adjacent to the opposing first and second side panels and the second end panel, the second retaining strap being sized to retain a selected second container in a selected position in the interior space of the bag between the second retaining strap and the second end panel, the first and second retaining straps being spaced apart from each other sufficient to define a goods-receiving portion of the interior space that is sized to receive selected goods therein.

16. A bag for carrying a selected container, comprising:

a bottom panel;

a pair of opposing first and second side panels attached to the bottom panel;

a pair of opposing first and second end panels attached to the bottom panel and to the side panels, the bottom panel, the side panels, and the end panels in combination defining an interior space of the bag;

a retaining strap securely positioned within the interior space adjacent to the opposing first and second side panels and the first end panel, the retaining strap being sized to retain the container in a selected position in the interior space of the bag between the retaining strap and the first end panel; and a retaining tab attached to the first end panel and extending into the interior space, the retaining tab being positioned to engage the container when positioned in the selected position in the interior space.

17. The bag of claim 11, further comprising a reinforcement panel positioned atop the bottom panel within the bag's interior area, the reinforcement panel being shaped and sized to reinforce the bottom panel.

18. A bag for carrying a selected container, comprising:

a bottom panel;

first and second side panels attached to the bottom panel and spaced apart from each other;

first and second end panels attached to the bottom panel and spaced apart from each other, the first and second end panels extending between the first and second side panels, the bottom panel, the first and second side panels, and the first and second end panels defining in combination an interior space of the bag; and the first end panel having first and second cuts formed therein to define an upper portion of the first end panel above the first cut, a lower portion of the first end panel below the second cut, and an intermediate portion of the first end panel between the first and second cuts, the intermediate portion being movable relative to the upper and lower portions between a stored position and a containing position, the intermediate portion being positioned at the upper and lower portions when in the stored position, and the intermediate portion being within the interior space and spaced apart from the upper and lower portions when in the containing position to define a container-receiving space therebetween for retaining the container in the container-receiving space between the intermediate portion and the upper and lower portions, the first and second cuts extending into the first and second side panels.

19. The bag of claim 18 wherein the second end panel has third and fourth cuts formed therein to define a second upper portion of the second end panel above the third cut, a second lower portion of the second end panel below the fourth cut, and a second intermediate portion of the second end panel between the third and fourth cuts, the second intermediate portion is movable relative to the second upper and lower portions between a second stored position and a second containing position, the second intermediate portion being positioned at the second upper and lower portions, and the second intermediate portion being within the interior space and spaced apart from the second upper and lower portions to define a second container-receiving space therebetween for retaining a second container in the second container-receiving space between the second intermediate portion and the second upper and lower portions.

20. The bag of claim 19 wherein the intermediate portion defined by the first and second cuts is a first retaining strap and the second intermediate portion defined by the third and fourth cuts is a second retaining strap, the first and second retaining straps are spaced apart by a selected distance to define a goods-receiving space therebetween within the interior space, the goods-receiving space being sized to receive selected goods when the first and second containers are within the first and second container-receiving spaces.

21. The bag of claim 18, further comprising a reinforcement panel removably attached to the bottom panel.

22. A bag for carrying a selected container, comprising:

a bottom panel;

first and second side panels attached to the bottom panel and spaced apart from each other;

first and second end panels attached to the bottom panel and spaced apart from each other, the first and second end panels extending between the first and second side panels; the bottom panel, the first and second side panels, and the first and second end panels defining in combination an interior space of the bag; and the first end panel having first and second cuts formed therein to define an upper portion of the first end panel above the first cut, a lower portion of the first end panel below the second cut, and an intermediate portion of the first end panel between the first and second cuts, the intermediate portion being movable relative to the upper and lower portions between a stored position and a containing position, the intermediate portion being positioned at the upper and lower portions when in the stored position, and the intermediate portion being within the interior space and spaced apart from the upper and lower portions when in the containing position to define a container-receiving space therebetween for retaining the container in the container-receiving space between the intermediate portion and the upper and lower portions, the first and second cuts each having a first cut portion extending a first direction and having a stop cut portion connected to the first cut portion, the stop cut portion extending in a second direction different than the first direction and positioned to prevent the first cut portion from extending past the stop cut portion.

23. The bag of claim 22 wherein the first cut portion terminates at a selected position in the first side panel, and the stop cut portion is formed in the first side panel.

24. A bag for carrying a selected container, comprising:

a bottom panel;

first and second side panels attached to the bottom panel and spaced apart from each other;

first and second end panels attached to the bottom panel and spaced apart from each other, the first and second end panels extending between the first and second side panels, the bottom panel, the first and second side panels, and the first and second end panels defining in combination an interior space of the bag;

the first end panel having first and second cuts formed therein to define an upper portion of the first end panel above the first cut, a lower portion of the first end panel below the second cut, and an intermediate portion of the first end panel between the first and second cuts, the intermediate portion being movable relative to the upper and lower portions between a stored position and a containing position, the intermediate portion being positioned at the upper and lower portions when in the stored position, and the intermediate portion being within the interior space and spaced apart from the upper and lower portions when in the containing position to define a container-receiving space therebetween for retaining the container in the container-receiving space between the intermediate portion and the upper and lower portions; and a retaining tab attached to the first end panel and extending into the interior space, the first retaining tab being positioned to engage an upper portion of the container when positioned in the container-receiving space.

* * * * *